US007413456B1

(12) United States Patent
DiFusco

(10) Patent No.: US 7,413,456 B1
(45) Date of Patent: Aug. 19, 2008

(54) QUICK CONNECT LIGHT BULB SOCKET

(76) Inventor: Frank DiFusco, 86 Wimmer Rd., Hopewell Junction, NJ (US) 12533

( * ) Notice: Subject to any disclaimer, the term of this patent is extended or adjusted under 35 U.S.C. 154(b) by 0 days.

(21) Appl. No.: 11/599,570

(22) Filed: Nov. 14, 2006

(51) Int. Cl.
*H01R 4/38* (2006.01)

(52) U.S. Cl. ..... 439/257; 439/356; 439/665; 439/253

(58) Field of Classification Search ..... 439/356, 439/157, 668, 226, 255, 253, 257, 665
See application file for complete search history.

(56) References Cited

U.S. PATENT DOCUMENTS 2,869,097 A * 1/1959 Stuart ..... 439/256
3,895,195 A 7/1975 Morrison et al.
3,915,536 A 10/1975 Glantz
3,936,122 A 2/1976 Hagelberg
4,222,623 A 9/1980 Hultberg
4,279,458 A 7/1981 Knapp
4,319,796 A 3/1982 Wiley
4,548,449 A 10/1985 Corsetti
4,621,885 A * 11/1986 Szczesny et al. ..... 439/357
4,768,966 A 9/1988 Doherty
4,778,409 A 10/1988 Maddock
4,824,393 A 4/1989 Armbruster
4,883,434 A 11/1989 Toyoshima
5,030,124 A 7/1991 Lorentzon
5,154,628 A 10/1992 Skegin
5,171,292 A * 12/1992 Ortiz ..... 439/253
5,278,741 A 1/1994 Ehrman
5,380,214 A 1/1995 Ortega
5,456,611 A 10/1995 Henry et al.
5,595,513 A 1/1997 Kondo
5,743,758 A 4/1998 Cheng et al.
5,800,212 A 9/1998 Hsu
5,989,070 A 11/1999 Al-Turki
6,322,380 B1 11/2001 Conroy
6,491,534 B1 12/2002 Bonard et al.
6,652,305 B1 11/2003 DiFusco

* cited by examiner

*Primary Examiner*—Renee Luebke
*Assistant Examiner*—Harshad C Patel
(74) *Attorney, Agent, or Firm*—Michael I. Kroll

(57) ABSTRACT

The present invention relates to an electrical socket for a standard light bulb. The socket is configured to allow the bulb to be pushed into and pulled from the socket. The sockets are provided with spring members where the spring members have ridges thereon to engage the threaded end of the light bulb. The spring members are unevenly spaced about the circumference of the socket and the spring members are provided with an upper end that can move vertically away from the bottom of the socket. When a bulb is pushed into the socket, the force of the bulb on ridges on the spring members cause the spring members to elongate and allow the bulb to slide into the socket. When the bulb is pulled from the socket the spring members elongate allowing the bulb to slide from the socket.

21 Claims, 13 Drawing Sheets

QUICK CONNECT LIGHT BULB SOCKET

BACKGROUND OF THE INVENTION

1. Field of the Invention

The present invention relates generally to electrical sockets and, more specifically, to a light bulb socket having an improved and expedient means of connection whereby the user may insert into place and establish electrical connection to a light bulb by simply inserting said light bulb into a base socket with no rotational manipulation, furthermore the user may also remove a light bulb from the present invention by an opposed pulling action.

The present invention is an electrical socket having spring members for grasping the threaded end of a light bulb. The bulb is held in position in the socket so that a central point on the bottom of the threaded end of the bulb is held in contact with a leaf spring located on the inner surface of the bottom of the socket. The outer bottom surface of the socket has two areas for securing the leads of an electrical wire thereon properly connecting the bulb with the necessary electrical power.

2. Description of the Prior Art

There are other light sockets designed for installing and removing light bulbs. Typical of these is U.S. Pat. No. 5,380,214 issued to Ortega on Jan. 10, 1995.

Another patent was issued to Ehrman on Jan. 11, 1994 as U.S. Pat. No. 5,278,741. Yet another U.S. Pat. No. 5,154,628 was issued to Skegin on Oct. 13, 1992 and still yet another was issued on Nov. 28, 1989 to Toyoshima et al. as U.S. Pat. No. 4,883,434.

Another patent was issued to Maddock et al on Oct. 18, 1988 as U.S. Pat. No. 4,778,409. Another patent was issued to Wiley et al on Mar. 16, 1982 as U.S. Pat. No. 4,319,796. Another patent was issued to Al-Turki et al on Nov. 23, 1999 as U.S. Pat. No. 5,989,070. Another patent was issued to Hsu et al on Sep. 1, 1998 as U.S. Pat. No. 5,800,212. Another patent was issued to Kondo et al on Jan. 21, 1997 as U.S. Pat. No. 5,595,513. Another patent was issued to Armbruster et al on Apr. 25, 1989 as U.S. Pat. No. 4,824,393.

Another patent was issued to Morrison et al on Jul. 15, 1975 as U.S. Pat. No. 3,895,195. Another patent was issued to Glantz on Oct. 28, 1975 as U.S. Pat. No. 3,915,536. Another patent was issued to Hagelberg on Feb. 3, 1976 as U.S. Pat. No. 3,936,122. Another patent was issued to Hultberg on Sep. 16, 1980 as U.S. Pat. No. 4,222,623. Another patent was issued to Knapp on Jul. 21, 1981 as U.S. Pat. No. 4,279,458. Another patent was issued to Eisert et al on Oct. 22, 1985 as U.S. Pat. No. 4,548,499.

Still another patent was issued to Doherty on Sep. 6, 1988 as U.S. Pat. No. 4,768,966. Another patent was issued to Lorentzon on Jul. 9, 1991 as U.S. Pat. No. 5,030,124. Another patent was issued to Henry on Oct. 10, 1995 as U.S. Pat. No. 5,456,611. Another patent was issued to Kondo on Jan. 21, 1997 as U.S. Pat. No. 5,595,513. Another patent was issued to Cheng on Apr. 28, 1998 as U.S. Pat. No. 5,743,758. Another patent was issued to Conroy on Nov. 27, 2001 as U.S. Pat. No. 6,322,380. Still yet another patent was issued to DiFusco on Nov. 25, 2003 as U.S. Pat. No. 6,652,305.

U.S. Pat. No. 3,895,195

Inventor: Morrison

Issued: Jul. 15, 1975

A shock proof electrical lightbulb socket which generally includes a body, a positive terminal and a negative terminal mounted on the body for electrical connection to an electrical power line, and a lightbulb receiver mounted within the body having an open top and a closed bottom for receiving the end of a lightbulb. The lightbulb receiver includes an internally threaded open ended electrically conductive shell adapted to contact the conductive sleeve of the lightbulb and the negative terminal, and a base contact at the bottom of the receiver which is adapted to contact the bottom contact of the lightbulb and the positive terminal. The shell and bottom contacts are normally spaced from the respective terminals when a lightbulb is not fully screwed into the receiver. In one embodiment the socket includes a circuit completion mechanism movably mounted between the receiver and the body of the socket for establishing a circuit only in response to the insertion of a lightbulb into the receiver to move the circuit completion mechanism. In another embodiment, the interior of the body and the outside of the receiver have mating threads formed thereon so that the receiver can be threadably reciprocably moved relative to the body. The circuit can be completed only by threadably moving the contacts of the receiver to contact the terminals by rotating the lightbulb. In still another embodiment, the base contact is secured to the body, and the lightbulb receiver is mounted for reciprocal movement within the body relative to the body and base. The lightbulb receiver has downwardly extending portions which are adapted to engage terminals mounted below the base contact. As the lightbulb is screwed into the receiver, the receiver is moved outwardly relative to the socket thereby causing completion of the circuit U.S. Pat. No. 3,915,536

Inventor: Glantz

Issued: Oct. 28, 1975

A holder for an electric lamp which comprises a first contact element guided for movement through a plug of insulating material separating the lamp opening of the holder from the terminals, and furthermore comprises a second contact element located laterally of and in spaced relationship to the first contact element while being connected thereto to be brought into contact with its corresponding terminal as a result of the movement of the first contact element caused by introduction of the lamp. The first contact element on the side of the plug of insulating material which is facing away from the lamp opening and by means of an insulating carrier carries the second contact element so as to make the latter tiltable and restrictedly displaceable along the axis of the lamp holder. The terminal corresponding to the second contact element and a lateral contact spring leading to the side of the plug of insulating material facing the lamp opening are each provided at points spaced from each other, with a conductive support point for the second contact element which latter is forced against the support points when making contact. When full contact pressure has been achieved, the terminal leading to the first contact element is situated at a lower level relative to the support points of the second contact element than is the case when there is no contact pressure U.S. Pat. No. 3,936,122

Inventor: Hagelberg

Issued: Feb. 3, 1976

The present invention relates to a safety device in electrical connection devices, especially lamp-holders, comprising a number of contact parts designed to rest against an object arranged to be connected to the connection device, for example a light bulb socket, and a number of elements arranged to be connected to the electric leads of a cable, whereby the contact parts are at a distance from the respective connector elements and are arranged by means of being pushed in by a spring function to achieve contact with these during connection of said object to the device. According to the invention the device is provided with at least one insulating element, forced to be between the contact parts and the respective connector elements and thereby prevent contact between these when said object is removed from the connection device, and simultaneously arranged to be moved by means of the object during its connection to a position in which the contact parts and the respective connector elements are free from the insulating element to be pressed against each other by means of the object by its connection U.S. Pat. No. 4,222,623

Inventor: Hultberg

Issued: Sep. 16, 1980

This invention relates to a holder for a glow-lamp or a bulb and comprises internally in said holder a switch mechanism which on its side facing the bulb has contacts for providing electric contact with the contact surfaces of the lamp base, and which has terminals for the conductors connected to the holder, the electric connection between the terminals and the contacts being interruptible when removing the bulb from the holder U.S. Pat. No. 4,279,458

Inventor: Knapp

Issued: Jul. 21, 1981

A releasable electrical connector consisting of a connector plug mating with a corresponding connector receptacle which may be disconnected by a separating force applied to a surrounding operating sleeve and the connector receptacle. The operating sleeve is shifted axially by the separating force against the bias of compression springs to a release position. The springs are received within grooves formed along the exterior of a segmented spring retaining housing, the segments forming an anchoring flange disposed within a recess formed about the connector plug. A plurality of arcuate threaded coupling segments assembled within the operating sleeve provide a threaded coupling, which segments in the nonreleasing position of the operating sleeve are positioned radially inward to mate with a corresponding thread on the receptacle and serve to create a mating force between the receptacle and plug upon rotation of the operating sleeve and to retain the connector and plug in the connected position. In the releasing position of the operating sleeve, the arcuate coupling segments are moved radially outward into a pair of axially spaced recesses by a camming action occurring between the mating threads on the receptacle and segments to allow the release of the receptacle from the plug. Anti-vibration springs are provided on a plurality of arcuate segments which engage ratchet teeth formed on the exterior of the connector plug to prevent vibration-induced unthreading of the arcuate segments and plug.

U.S. Pat. No. 4,548,449

Inventor: Corsetti

Issued: Oct. 22, 1985

A lamp socket attachment to convert a conventional screw-type light bulb socket into a spring insert type socket comprises a hollow cylindrical member open at both ends made of electrically non-conductive material divided by a transverse partition into upper and lower cup-like compartments, a cylindrical plug made of electrically non-conductive material is fixed concentrically in the lower compartment, there is a bore centrally through the plug and the partition, a contact member made of electrically conductive material slides captive in the bore, the contact member being adjustable in length, and there is a conductor member made of electrically conductive material having a lower portion extending along the outside of the plug through the partition and an upper portion extending along the inside surface of the upper compartment, such conductor member being structured so its lower portion will engage the threads of a screw-type bulb socket when the plug is inserted into the bulb socket and its upper portion will engage the threads of a conventional screw base light bulb inserted into the upper compartment of the lamp socket attachment.

U.S. Pat. No. 4,768,966

Inventor: Doherty

Issued: Sep. 6, 1988

A lampholder for a screw-in lightbulb has a body supporting two cable terminals for connection to an electrical supply, and a contact carrier mounted on the body and defining a bulb receiving socket, the contact carrier being movable between first and second positions relative to the body in a direction parallel to the insertion direction of a bulb and supporting terminals which connect an inserted bulb to the cable terminals when the carrier is in the first position but are spaced from the cable terminals when the carrier is in the second position. A spring pushes the carrier to the second position. When a bulb is screwed part-way into the carrier socket it bears against a fixed abutment so that the carrier is moved from the second to the first positions as the bulb is screwed fully into the socket. Each cable terminal overlaps with a respective carrier terminal in the axial direction and an insulating support is provided which is fixed in position relative to one terminal of each cable/contact terminal pair. The insulating support is such that as the carrier moves from the first to the second positions the terminal which moves is moved onto the partition and out of contact with the other terminal U.S. Pat. No. 5,030,124

Inventor: Lorentzon

Issued: Jul. 9, 1991

When screwing in a bulb into the lamp-holder according to the invention, which is carried out in an axially somewhat movable, threaded yoke (4), initially, via one of two resilient contacts (20, 21) associated with contacts (19) provided on an outer plate (15) which is somewhat movable with respect to the yoke, the outer plate and an inner plate (9) provided with a pair of contacts (12) and immovable with respect to the yoke, are pressed towards each other until a stop (7*a*, 7*b*) on the lamp-holder housing (1) arrests the outer plate or the yoke before the pairs of contacts are brought together. By the continued threading motion of the bulb and by the fact that now the outer plate or the yoke are immovable with respect to the housing the plates are moved towards each other until their contact pairs are brought together and the yoke or the outer plate is arrested by the said stop. The contact pairs cannot be brought together by an object without it cooperating with the thread (5) of the yoke.

U.S. Pat. No. 5,456,611

Inventor: Henry

Issued: Oct. 10, 1995

This invention in its preferred embodiment, is directed to a miniature UHF type plug, more particularly to a female, snap-on coaxial cable connector for use with radio-frequency and other transmission lines, where such connector is electrically connectable to a male, receptacle connector, typically panel mounted and of a design as known in the art. The snap-on, coaxial connector comprises three primary members identified as a circular sleeve, a circular shell, and a circular collar. The circular sleeve includes a plurality of spaced-apart, axially oriented tynes along a first end thereof, and the circular shell consists of a cable crimping section, an intermediate section to be received within the sleeve, and a third section having a like plurality of spaced-apart, axially oriented tynes. The latter tynes are arranged to intermate with the first tynes, and the intermated tynes are adapted to receive the male, receptacle connector. The shell is further characterized by means to retain the axial position of the shell within said sleeve, and by means cooperating with the male, receptacle connector to prevent rotative movement therebetween, where preferably such means comprise a compliant, elastomeric spacer member. The circular retaining collar is provided to receive the sleeve, and cooperative means are further provided between the collar and the sleeve to limit the axial movement therebetween.

U.S. Pat. No. 5,595,513

Inventor: Kondo

Issued: Jan. 21, 1997

A bulb socket terminal to be accommodated in a socket body of a connector bulb socket. The terminal includes a base, an elastic contact portion adapted to contact a filament or an earth of a bulb on one side of the base, and a connecting portion adapted to be connected to a connector on the other side thereof. The bulb socket terminal is integrally formed intermediate of the elastic contact portion and the connecting portion with a resin flow blocking wail which contacts an insert-molding metal mold to seal an area of the elastic contact portion at the time of insert-molding. Accordingly, the area where the elastic contact portion extends is sealed by the rein flow blocking wall at the time of insert-molding with use of the metal mold to thereby prevent the resin from flowing into this area. Therefore, the spring elasticity of the elastic contact portion will not be restricted.

U.S. Pat. No. 5,743,758

Inventor: Cheng

Issued: Apr. 28, 1998

A lamp socket in which the socket body is formed of two symmetrical halves connected together a dovetail joint; a rubber packing ring is mounted around the bottom lamp hole of the socket body to prohibit water from passing to the inside of the socket body after the installation of the lamp bulb; a movable metal contact plate is suspending inside the socket body and adapted for connecting the tip contact of the lamp bulb to the positive metal contact plate upon the insertion of the lamp bulb in the socket body; a spring is mounted inside the socket body to force the movable metal contact plate downwardly away from the positive metal contact plate after the removal of the lamp bulb.

U.S. Pat. No. 6,322,380

Inventor: Conroy

Issued: Nov. 27, 2001

A safety light socket including a cylindrical socket defined by an upper end, a lower end, and a cylindrical side wall therebetween. The cylindrical socket includes a cylindrical recess extending downwardly of the upper end thereof. The cylindrical recess includes an open upper end, a closed lower end, and an interior cylindrical wall therebetween. The interior cylindrical wall is threaded for receiving a light bulb. The closed lower end of the cylindrical recess has a spring extending upwardly therefrom. A primary contact is secured to the spring of the cylindrical recess of the cylindrical socket. A secondary contact is secured to the closed lower end of the cylindrical recess of the cylindrical socket U.S. Pat. No. 6,491,534

Inventor: Bonard

Issued: Dec. 10, 2002

A socket for an electric light is provided including a first electric supply circuit, a second electric supply circuit, and a safety device adapted to detect presence or absence of a light bulb in the socket.

U.S. Pat. No. 5,380,214

Inventor: Jerry Ortega

Issued: Jan. 10, 1995

A push-in light socket adapter for use with a conventional household light bulb socket for facilitating a rapid removal and replacement of a light bulb. The adapter includes a threaded socket body which may be engaged to the household light bulb socket in place of the light bulb. The light bulb may then be inserted directly into the adapter without rotating the bulb. The adapter allows a removal of a burnt-out light bulb by a simple pulling motion which releases the bulb from the socket body. A new bulb may then be easily inserted into the adapter by pushing it into the socket body. The light socket adapter further includes an indicator light operable to indicate both a supply of electrical power to the device and a presence of the light bulb within the socket body.

U.S. Pat. No. 5,278,741

Inventor: Moshe Ehrman

Issued: Jan. 11, 1994

An apparatus for fixing rotary heads to an upper drum of a rotary drum of a video cassette recorder includes a guide projection formed on a lower surface of each of the rotary heads, guide grooves formed in the upper drum for engagement with the guide projections of the rotary heads, and setting means for fixing the rotary heads engaged with the guide grooves of the upper drum to the upper drum. The apparatus enables the rotary heads to be mounted on the upper drum simply, accurately, and at constant angular intervals.

U.S. Pat. No. 5,154,628

Inventor: Maer Skegin

Issued: Oct. 13, 1992

A bayonet type socket improved for handling heavy currents of Halogen bulbs has a socket shell with one or more rivet shaped electrical contacts carried by an insulating disc supported on a main spring in the shell. Each rivet contact is movable on the disc and is driven by an auxiliary spring against the base of the light bulb to ensure positive electrical contact. A superior ground connection is provided by a separate grounding element fitted on the socket exterior.

U.S. Pat. No. 4,883,434

Inventor: Akira Toyoshima

Issued: Nov. 28, 1989

A wedge-base lamp and socket assembly includes a wedge-base lamp having a pair of projections formed on opposite sides near the center of a base of the wedge-base lamp; and a socket having a pair of resilient arms which come in engagement with the pair of projections when the wedge-base lamp is mounted within the socket. A single filament type wedge-base lamp has fool-proof projections formed on opposite sides at opposite end portions of the base, and a double filament type wedge base socket has abutment portions which come in engagement with the fool-proof projections when the single filament type wedge-base lamp is inserted into the double filament type socket to thereby prevent erroneous coupling therebetween.

U.S. Pat. No. 4,778,409

Inventor: William H. Maddock

Issued: Oct. 18, 1988

A molded electrical lamp socket includes threaded, insulating portions on the inner wall of the socket to engage the lamp. The side electrode providing electrical contact for the lamp is desirably set deeply within the socket, to reduce the danger of accidental finger contact with an electrically conducting lamp. Where the side electrode is of the edge-on type, the insulating threads center the lamp in the socket and reduce the incidence of shaving and jamming of the lamp. U.S. patent U.S. Pat. No. 4,319,796

Inventor: Emmett H. Wiley

Issued: Mar. 16, 1982

A compact lamp unit and associated socket for use in a projection system such as a slide projector, microfilm viewer, and so forth. The lamp unit includes a reflector molded from a plastic material and an electric lamp secured within the reflector. In order to decrease the axial dimension of the reflector and to avoid the use of pin connectors, electrical contacts for the lamp are pressed into recesses formed in the outer surface of the reflector. The reflector includes an opening at its apex through which electrical leads from the lamp extend outwardly of the reflector. The electrical leads are secured to the contacts by being forced into the recesses along with the contacts. This construction technique is fast and simple. The lamp unit also includes a handle to enable a heated lamp unit to be replaced by the user and a guide means to enable the lamp unit to be oriented quickly and accurately upon insertion into the socket. In their preferred forms, the handle and the guide means are identically configured and comprise fins extending outwardly of the convex surface of the reflector, the fins lying on opposite sides of the opening and in the same plane. The socket into which guide means is inserted includes a first upstanding member defining a reference plane against which a portion of the reflector is engaged in use. A second upstanding structure engages another portion of the reflector to securely retain the reflector when it is inserted into the socket. The socket includes a pair of flexible contacts engageable with the contacts carried by the lamp unit, the socket contacts being positioned in a plane substantially parallel with the reference plane. When the lamp unit is inserted into the socket, the socket contacts are flexed sufficiently to make good electrical contact with the contacts carried by the lamp unit. A retention mechanism in the form of a flexible bail may be used to prevent inadvertent displacement of the lamp unit from the socket. U.S. patent U.S. Pat. No. 5,989,070

Inventor: Ali Al-Turki

Issued: Nov. 23, 1999

A light bulb-socket adapter for connecting a bayonet type light bulb to an Edison type socket or an Edison type light bulb to a bayonet type socket. The light bulb-socket adapter includes an Edison type connector section made of conductive material and a connection terminal extending therefrom and a bayonet type bulb receiving section and first and second contact terminals positioned within the receiving section for connecting a bayonet type light bulb to an Edison type socket. The light bulb-socket adapter includes a bayonet type connector section and first and second contact terminals extending from the connector section and an Edison type bulb receiving section made of conductive material and a connection terminal extending therefrom for connecting an Edison type light bulb to a bayonet type socket. Each adapter includes a nonconductive barrier layer connected between and electrically isolating said Edison type section and bayonet type section, a first connection wire connecting the conductive material of the Edison type section to the first connection terminal of the bayonet type section and a second connection wire connecting the contact terminal of the Edison type section to the second connection terminal of the bayonet type section. When the adapter is connected between a bulb and socket, the bulb and socket form a complete circuit via the first and second wires respectively.

U.S. Pat. No. 5,800,212

Inventor: Min-Hsun Hsu

Issued: Sep. 1, 1998

An improved plug-in type light bulb including a light bulb with a plug unit and an electrical socket for receiving the light bulb. The socket is comprised of two symmetrical halves each of which includes an upper portion and a lower portion. A cover plate with a notch is disposed inside at the upper portion, while a plurality of grooves are formed at the lower portion. A plurality of electrically conductive plates are disposed in the grooves and each of which has an angular contact terminal. The plug unit has two side walls each of which has an integrally formed raised block and two lateral walls against which the corresponding contact terminals of the lead wires rest. The lateral walls are further provided with a respective half round groove across which the contact terminal is disposed. When the light bulb is inserted into the socket, the angular contact terminals of the conductive plates will fit into the insert grooves of the plug unit of the light bulb and cause a part of the respective contact terminals of the lead wires to fit into the same insert grooves to achieve firm electrical contact.

U.S. Pat. No. 5,595,513

Inventor: Hiroyuki Kondo

Issued: Jan. 21, 1997

A bulb socket terminal to be accommodated in a socket body of a connector bulb socket. The terminal includes a base, an elastic contact portion adapted to contact a filament or an earth of a bulb on one side of the base, and a connecting portion adapted to be connected to a connector on the other side thereof. The bulb socket terminal is integrally formed intermediate of the elastic contact portion and the connecting portion with a resin flow blocking wail which contacts an insert-molding metal mold to seal an area of the elastic contact portion at the time of insert-molding. Accordingly, the area where the elastic contact portion extends is sealed by the rein flow blocking wall at the time of insert-molding with use of the metal mold to thereby prevent the resin from flowing into this area. Therefore, the spring elasticity of the elastic contact portion will not be restricted.

U.S. Pat. No. 4,824,393

Inventor: Joseph M. Armbruster

Issued: Apr. 25, 1989

A socketless light bulb holder in the form of a substantially rigid, plastic bracket including a base affixed to a supporting structure with a generally centrally disposed mounting screw and a pair of terminal screws. The holder also includes a bulb holder portion snugly embracing the base of a light bulb. The terminals on the base of the light bulb are connected to conductor members extending from the terminals on the base of the light bulb to the terminal screws on the base of the holder with the conductor members being soldered to the terminals on the base of the light bulb thereby eliminating the necessity of the light bulb being inserted into and twisted in relation to a light bulb socket in order to mount the light bulb in the socket. In one embodiment of the invention, the holder includes a locking retainer for engagement with one of the bayonet pins which conventionally project radially from the base of the light bulb to mechanically lock the bulb in position. In another embodiment, the holder which snugly engages the base of the light bulb is provided with a slot enabling passage of one of the radially extending pins on the base of the light bulb. The positive soldered connection between the light bulb terminals and the conductor members eliminates points of corrosion which frequently result in the electrical energy supplied to the light bulb becoming interrupted.

While there are other light bulb sockets that may be suitable for the purposes for which they were designed, they would not be as suitable for the purposes of the present invention, as hereinafter described.

SUMMARY OF THE PRESENT INVENTION

A primary object of the present invention is to provide a light bulb socket that facilitates the easy and quick installation and removal of a light bulb.

Another object of the present invention is to provide a light bulb socket having a socket housing for connection to an electrical source and spring members for securing the light bulb in the socket and for transfer of power to a light bulb Yet another object of the present invention is to provide a light bulb socket that has springs members that flex for the insertion or removal of a light bulb Still yet another object of the present invention is to provide a light bulb socket that has spring members having ridges that allow for the ingress and egress of an inserted bulb.

Another object of the present invention is to provide a light bulb socket that has a leaf spring in its bottom terminal for secure connection of a light bulb to the present invention Yet another object of the present invention is to provide a light bulb socket that may be adaptable to existing light fixtures.

Additional objects of the present invention will appear as the description proceeds.

The present invention overcomes the shortcomings of the prior art by providing a socket for a light bulb having a socket housing to provide wired connection and a base socket for transfer of electric power to a light bulb that allows for easy installation of the bulb by a pushing action and removal of said light bulb buy a pulling action. Additionally the present invention is adaptable and replaceable for most existing lighting fixtures or applications.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
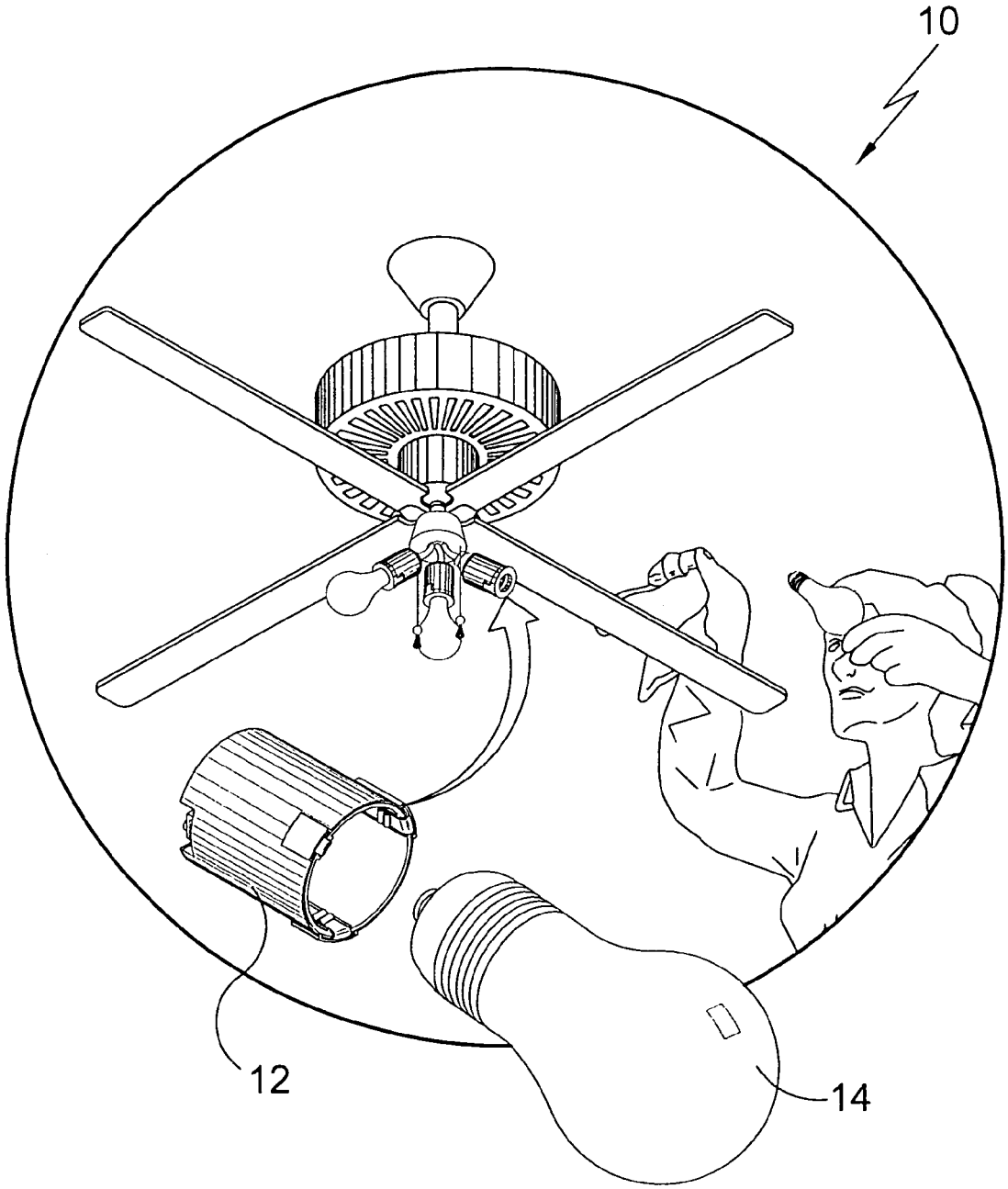
FIG. 1 is an illustrative view of the present invention in use.

With regard to reference numerals used, the following numbering is used the drawings.

10 Present Invention
12 Socket
14 Light Bulb
16 Spring Member
18 Bulb Threads
20 Hook
22 Slot
24 Groove
26 Ridge
28 Wire Contact
30 Screws
32 Leaf Spring

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 2:
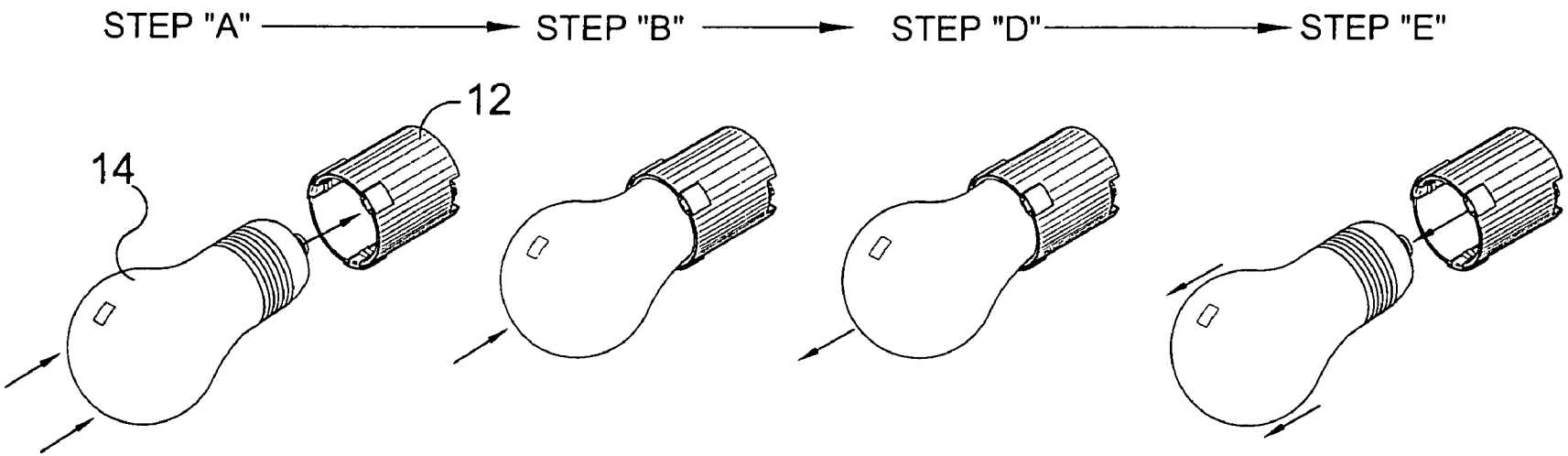
FIG. 2 is a perspective view of the steps involved in installing and removing a light bulb from the present invention.

FIG. 1 shows and illustrative view of the present invention 10. The present invention 10 is an electric socket 12 for receiving a light bulb 14 with a threaded end. In the prior art the light bulb is screwed into the prior art socket. In the present invention 10 provides a socket 12 where the bulb 14 is pushed in and pulled out of the socket 12 without twisting. The socket 12 has three spring members 16 that are in contact with the bulb threads 18. The bulb 14 is inserted into the socket 12 by pushing the bulb 14 down into the socket 12. The spring members 16 are designed so that they make contact with the bulb threads 18 once the bulb 14 is pushed into the socket. Once the user is ready to remove the bulb 14, the user grasps the bulb 14 and pulls the bulb 14 out of the socket. The pull of the user on the bulb 14 overcomes the hold of the spring members 16 so that the bulb 14 is removed from the socket 12. This makes the changing of light bulbs 14 quicker and easier and requires no twisting of the bulb 14. FIG. 2 is an illustrative view of a bulb 14 being pushed into and pulled out of a socket 12 of the present invention 10. To install the bulb 14, the user grasps the bulb 14 and pushes the threaded end of the bulb 14 into the socket 12. To remove the bulb 14, the user grasps the bulb 14 and pulls the bulb 14 from the socket.

Figure 3:
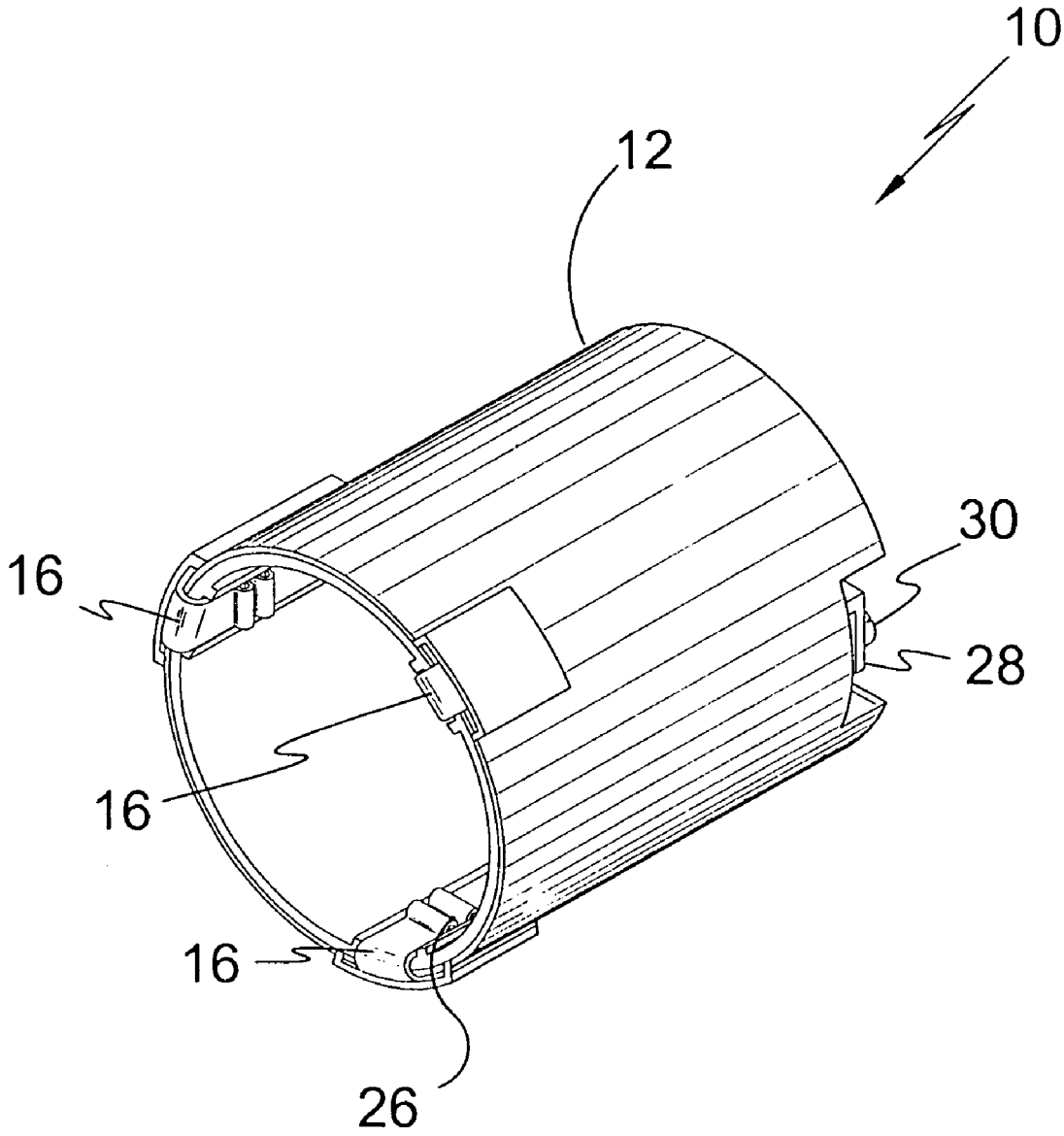
FIG. 3 is a perspective view of the present invention.
Figure 4:
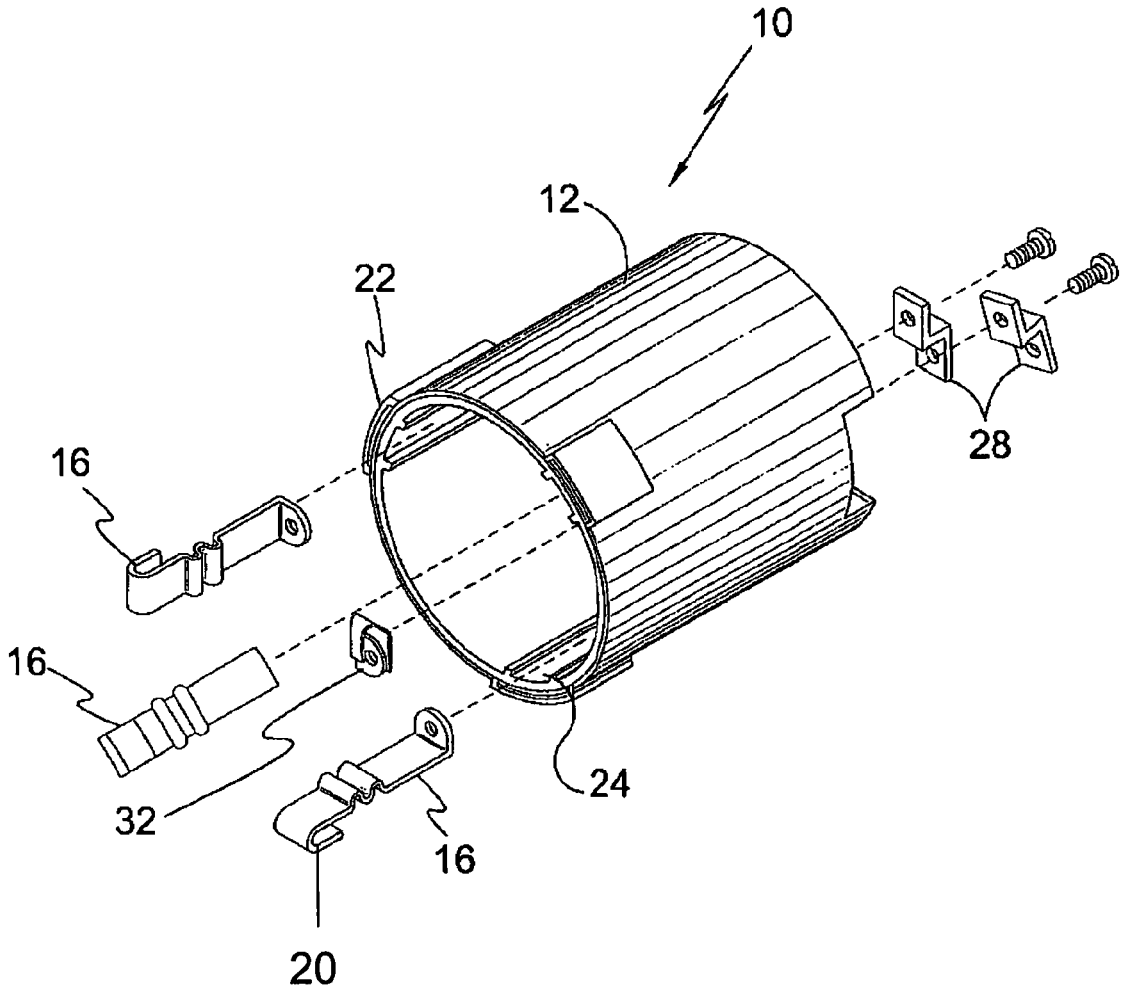
FIG. 4 is an exploded view of the present invention.
Figure 5:
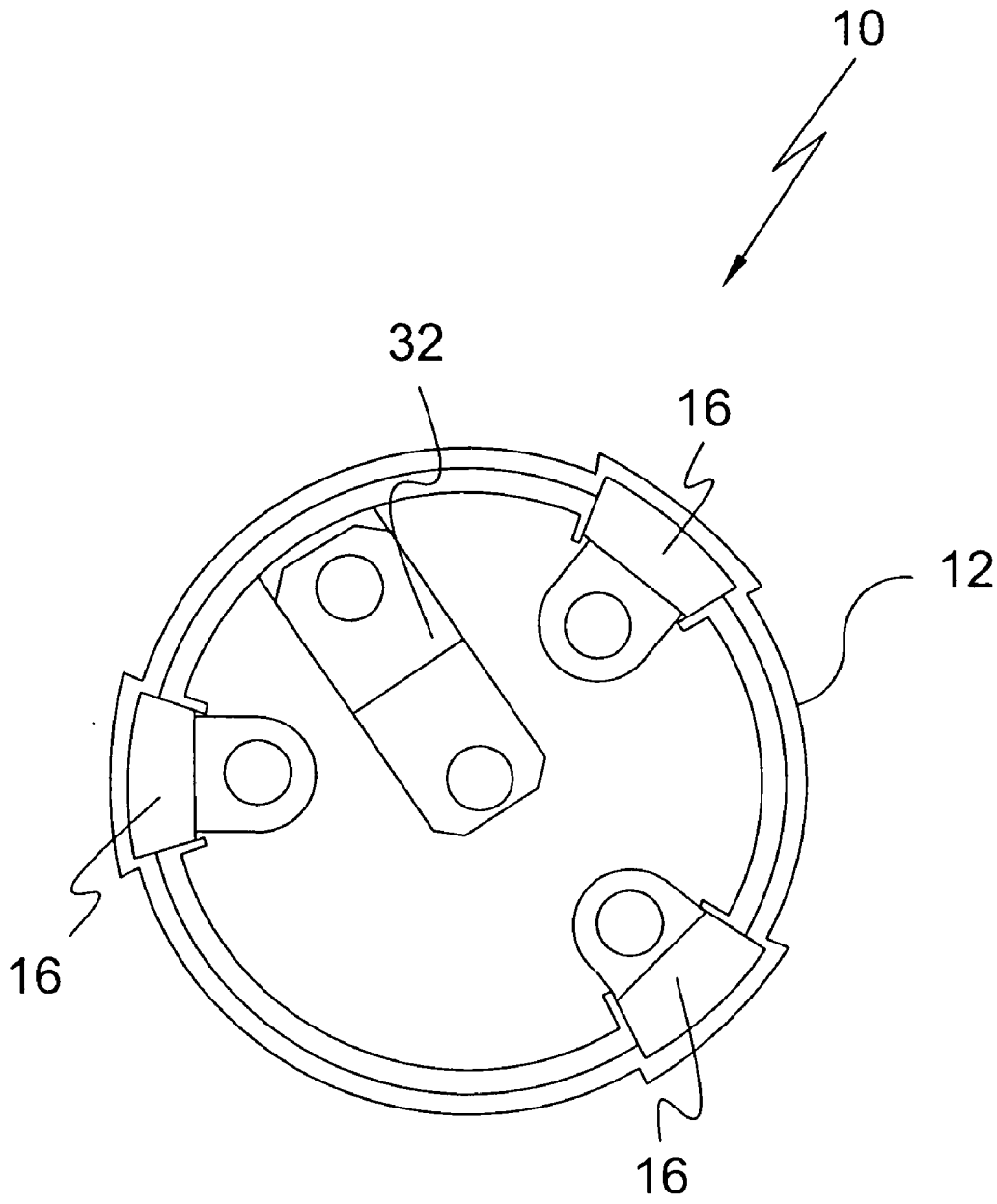
FIG. 5 is a top view of the present invention.
Figure 6:
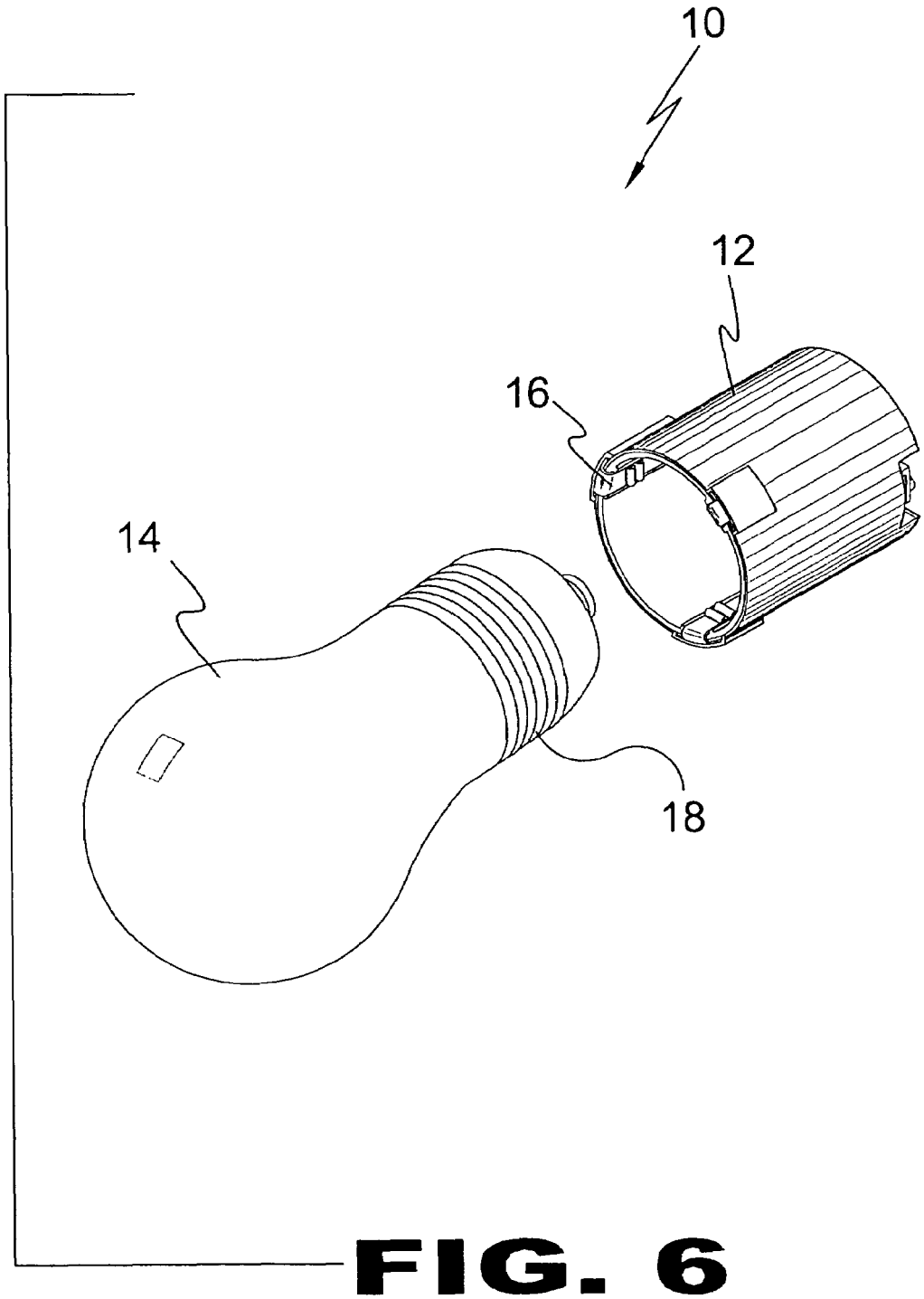
FIG. 6 is a perspective view of a conventional light bulb about to be inserted into the socket of the present invention.
Figure 7:
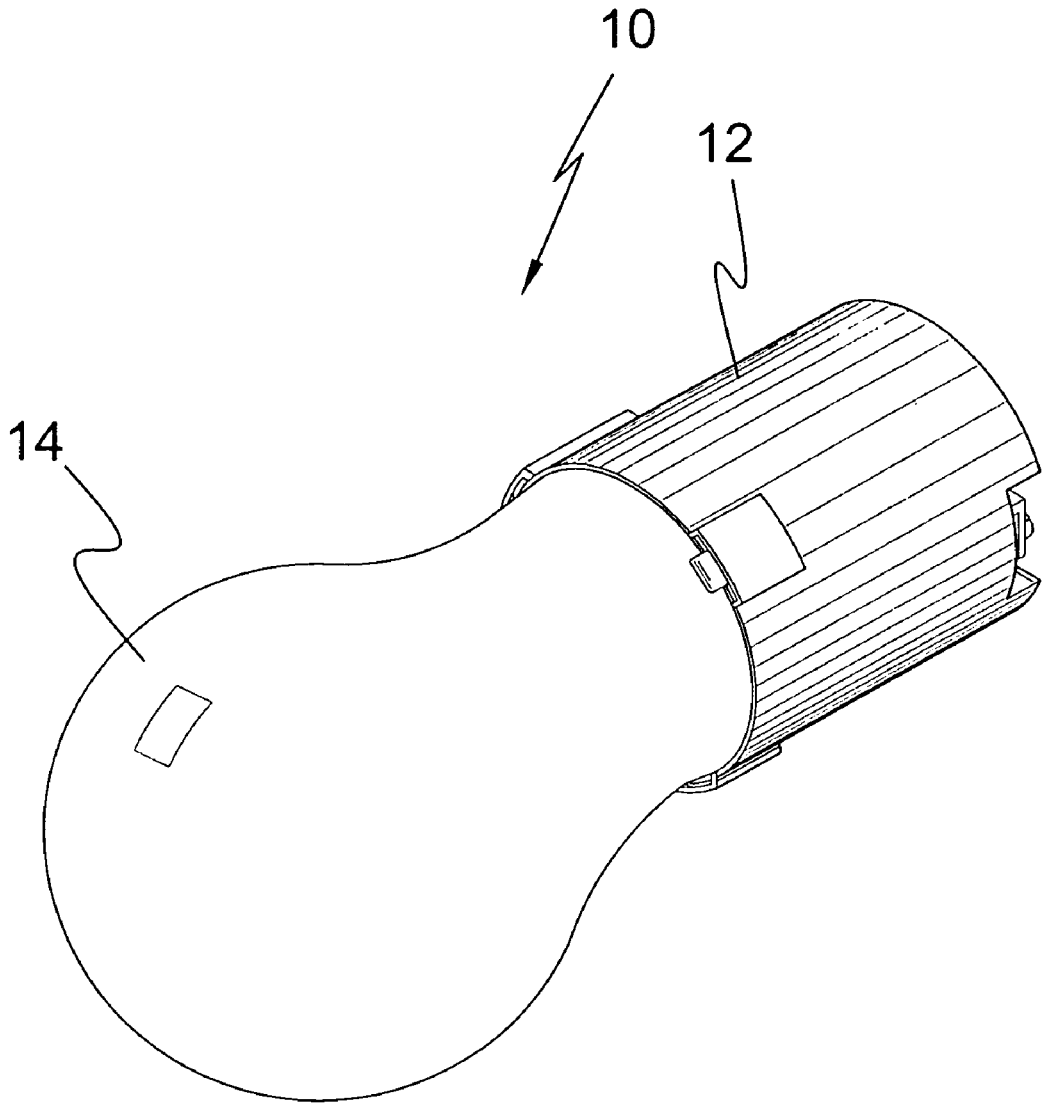
FIG. 7 is a perspective view of a conventional light bulb inserted into the socket of the present invention.
Figure 8:
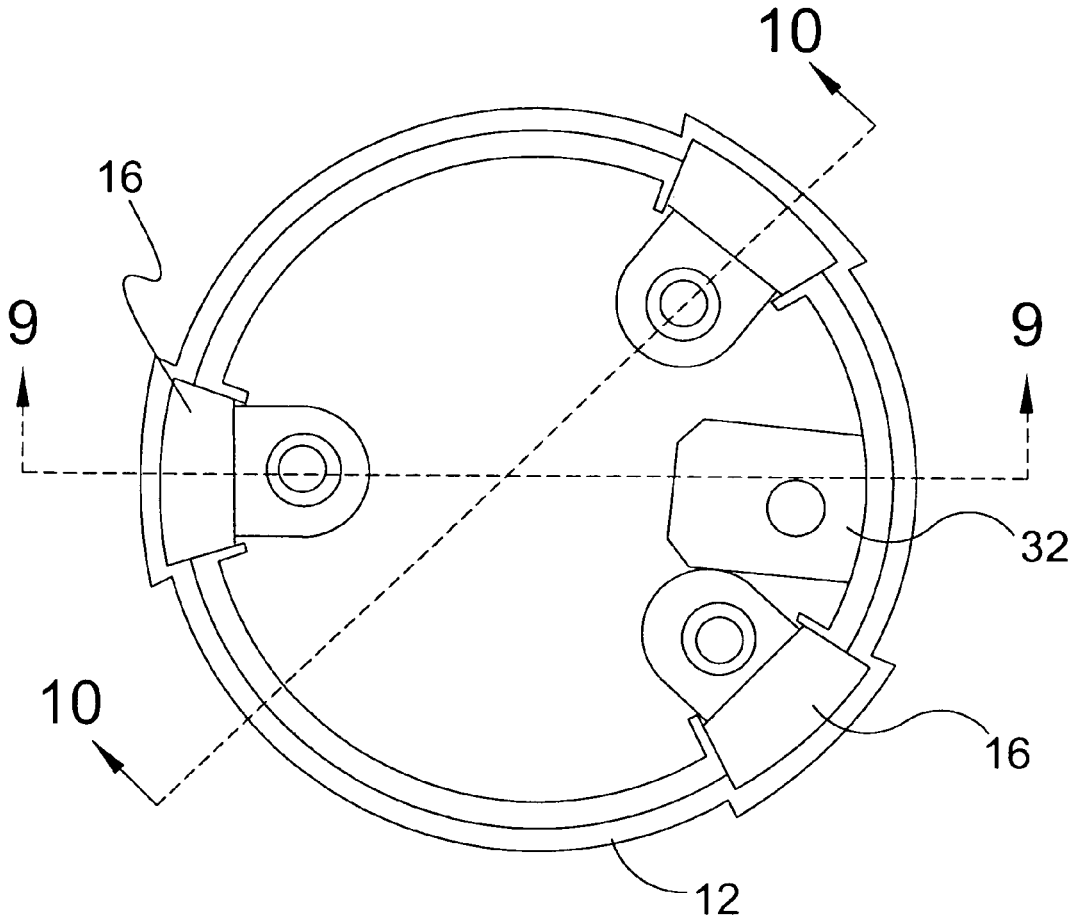
FIG. 8 is a top view of the present invention.

Looking at FIG. 3, an enlarged view of the socket 12 is shown. In one embodiment, there are two key features to the spring members 16, which allow a bulb 14 to be pushed into and pulled out of the socket. The first is how the spring members 16 are spaced circumferentially about the wall of the socket 12. Looking at FIGS. 5 and 8, we see how the spring members 16 are circumferentially spaced about the socket 12. From these Figures it is seen that the spring members 16 are not equally spaced about the circumference of the socket 12. Two of the spring members 16 are spaced closer to each other than they are to the third spring member 16. This configuration allows the bulb 14 to be removed with less force than if the spring members 16 were equally spaced about the circumference of the socket 12. The second is that the upper end of each spring member 16 is allowed to move vertically away from the bottom of the socket. The upper end of each spring member 16 is shown in FIG. 4 as having a hook 20, which wraps over the top edge of the socket 12. Each spring member has a terminal end that is disposed into a slot 22 located on the exterior of the socket 12 but is not secured in the slot 22. The slot 22 prevents side-to-side motion of the spring members 16 but allows upper end of the spring member 16 to move away from the bottom of the socket 12. Each spring member 16 is disposed in a groove 24 on the inner wall of the socket. The grooves 24 also prevent side-to-side movement of the spring members 16. Thus, when the bulb 14 is pushed into the socket 12 the spring members 16 elongate slightly. This is due to the force of the bulb 14 on the ridges 26 of the spring members 16. The ridges 26 tend to flatten causing the spring members 16 to elongate slightly. The flattening allows the bulb 14 to be pushed into the socket 12. Once the bulb 14 has been seated in the socket 12 the spring members 16 return to their original state and the ridges 26 hold the threaded end of the bulb 14 in the socket 12. The same happens upon removal. The force of the bulb 14 flattens the ridges 26 allowing the bulb 14 to be pulled from the socket 12. The spring members 16 have a lower end, which sits on the inner surface of the bottom of the socket 12 for contact through the bottom of the socket 12. The outer surface of the bottom of the socket 12 has two connections for attaching the black and white leads of an electrical wire. Wire contacts 28 shown are held in place on the bottom of the socket 12 with the threaded screws 30. These wire contacts secure the black and white leads of an electrical wire to two distinct conductive areas on the bottom of the socket 12, where one lead is secured to each conductive area. One of these conductive areas is connected through the bottom of the socket to the lower end of each of the three spring members 16. The other conductive area is connected through the bottom of the socket 12 to the leaf spring 32 that is typically centered in the bottom of the socket 12 or the portion that contacts the bottom of the bulb 14 is centered in the bottom of the socket 12. The spring members 16 are typically formed of a metal such as brass, copper, or aluminum. The socket 12 itself is made of a durable, heat resistant plastic material.

Figure 8A:
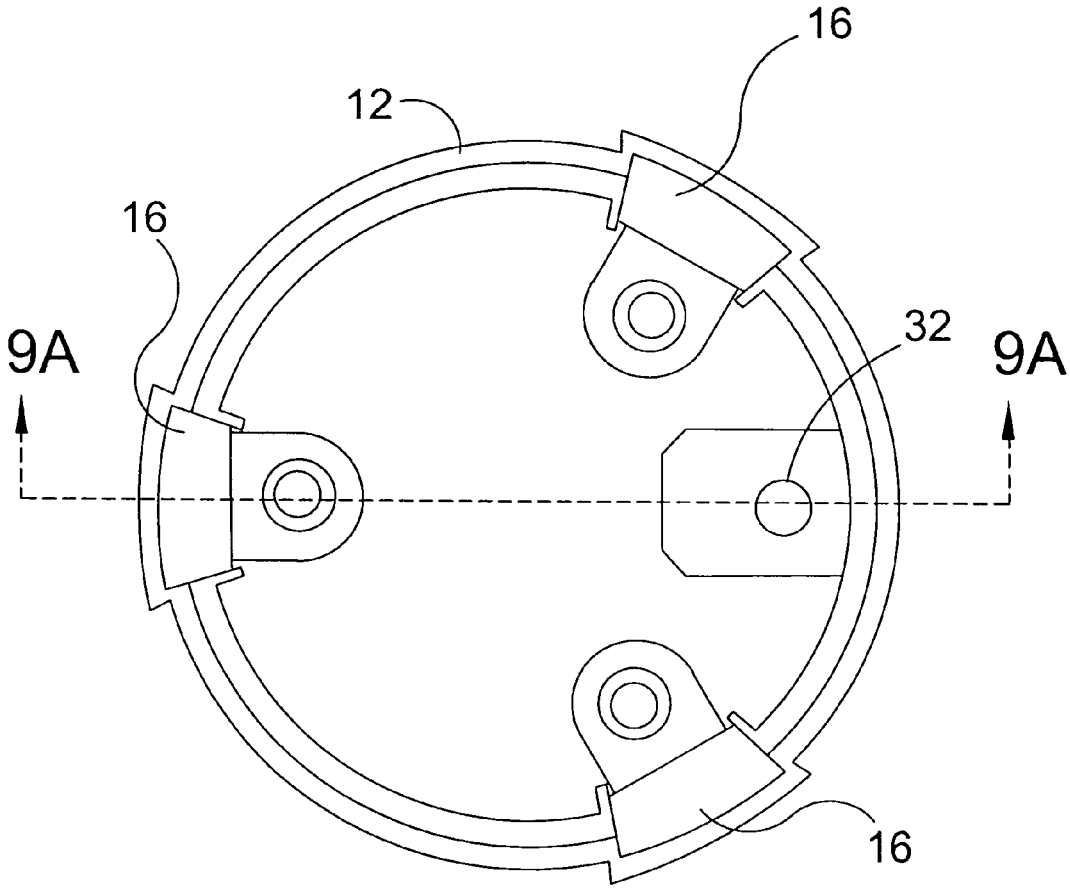
FIG. 8A is a top view of another embodiment of the present invention.

In another embodiment, the spring members 16 are spaced radially inward from the inner surface of the wall of the socket 12 and they are allowed to move radially outward towards the inner surface to allow the bulb 14 to be pushed into or pulled from the socket 12. In this embodiment the spring members 16 can be equally spaced from each other about the circumference of the socket 12 or they can be spaced in the manner of the previous embodiment. The upper end of each spring member 16 has a hook 20 that is wrapped over the wall of the socket 12 and into a slot disposed on an exterior surface of the wall, each spring member 16 is positioned in a groove 24, and the lower end is secured electrically through the bottom of the socket 12 in the same manner as the previous embodiment. The spring members 16 have ridges 26 as in the previous embodiment. This can be seen in FIGS. 8A and 9A.

Figure 9:
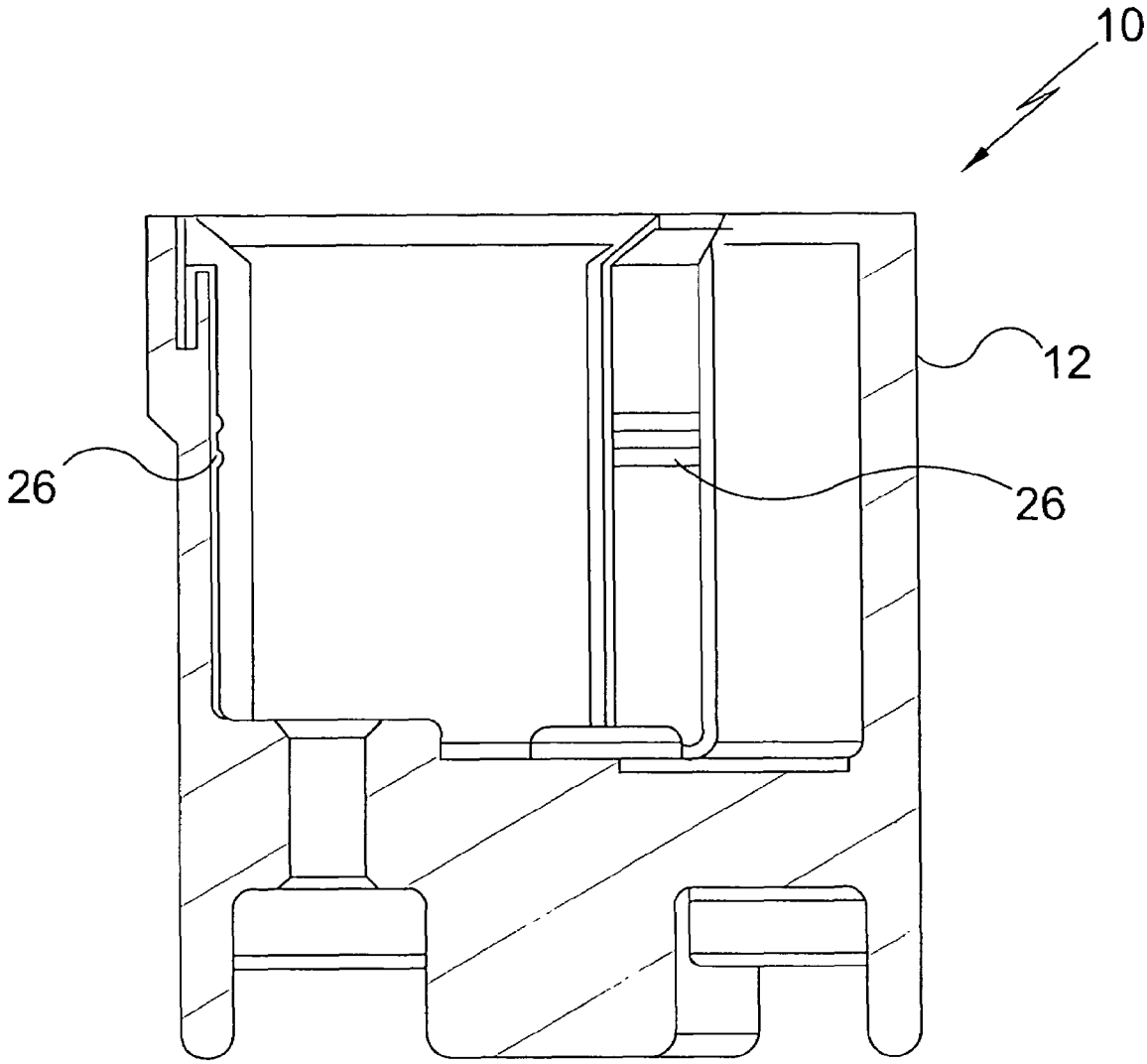
FIG. 9 is a sectional view of the present invention.
Figure 9A:
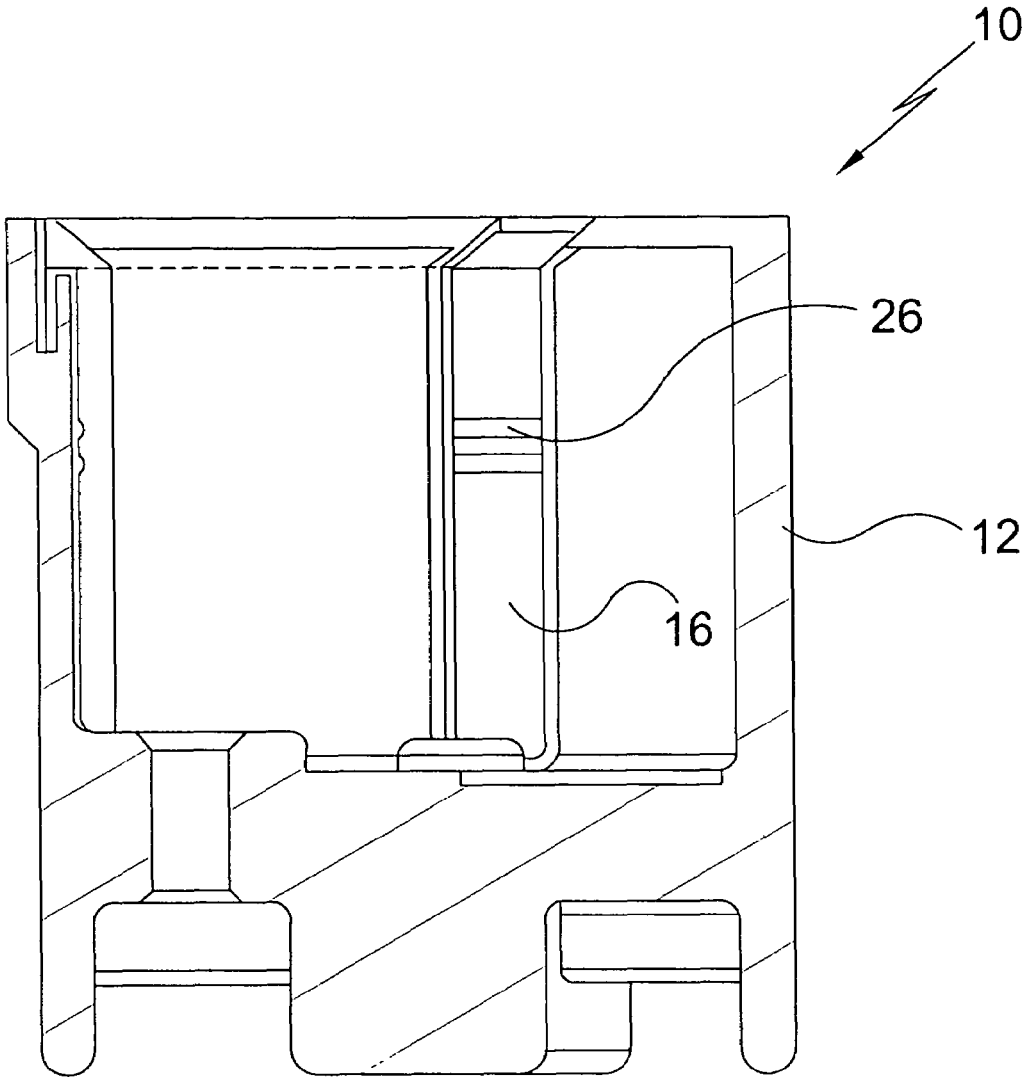
FIG. 9A is a sectional of the present invention.
Figure 10:
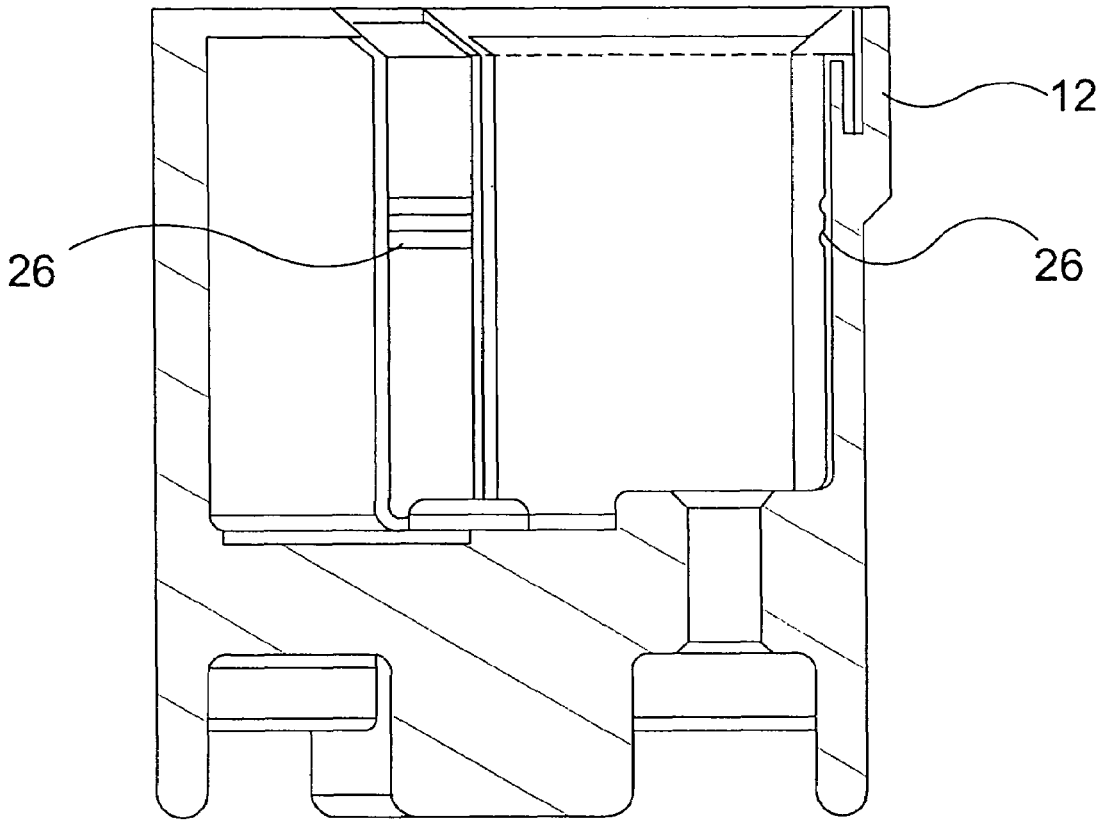
FIG. 10 is a sectional view of the present invention.
Figure 11:
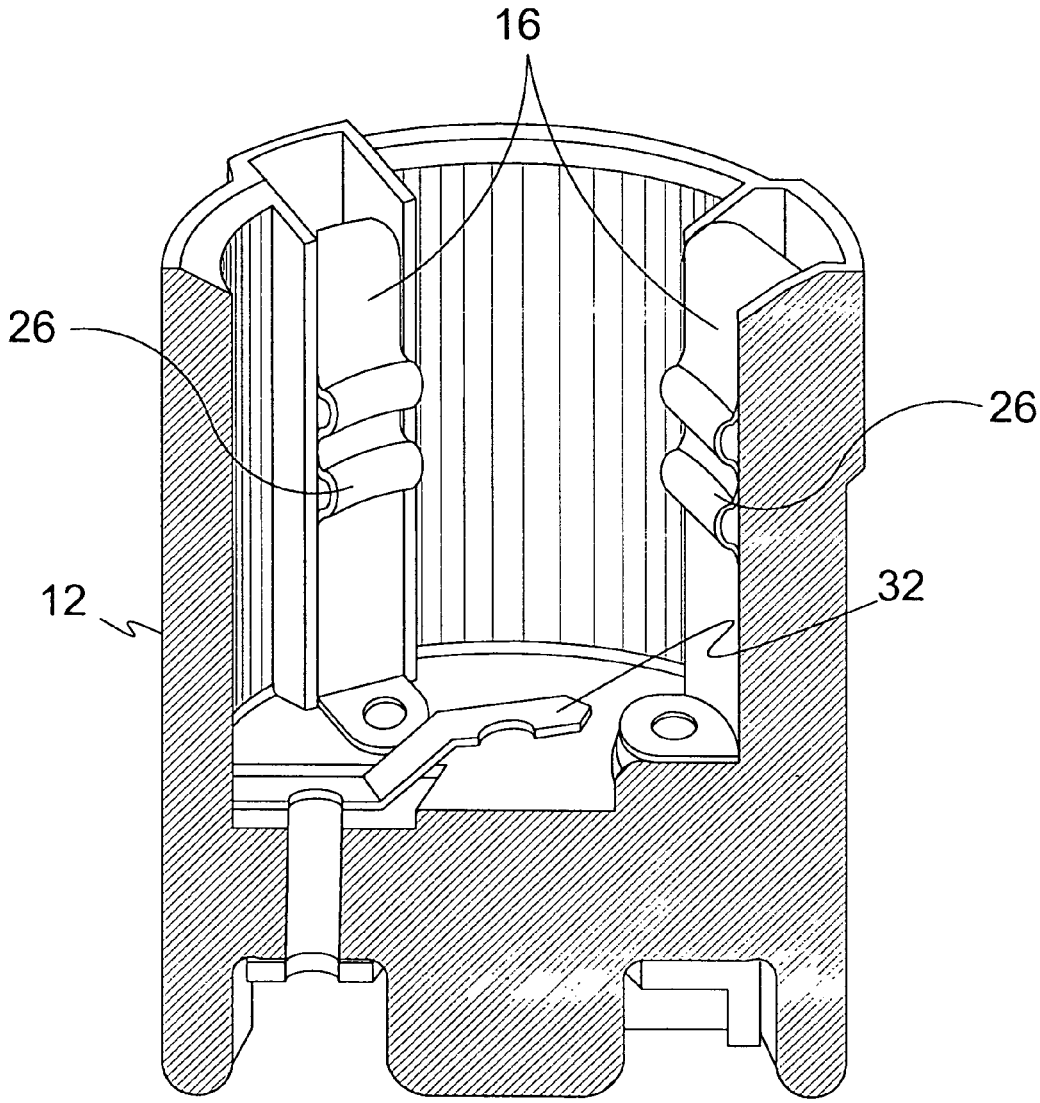
FIG. 11 is a cut-away view of the present invention.

Looking at FIGS. 9-11, sectional and cut away views of the present invention 10 are shown. It is from this view that the connections through the bottom of the socket 12 are seen. Electrically conductive rivets extend through the bottom connecting the spring members 16 a conductive area on the bottom of the socket 12. The leaf spring 32 member is connected to another conductive area on the bottom of the socket 12 by an electrically conductive rivet. The spring members 16 contact the side of the light bulb 14 thereby providing an electrical connection between the outside surface of the bulb 14 and one of the electrical wires (i.e. black). The leaf spring member 32, seen more clearly in FIG. 11, is positioned to make contact with the center of the bottom of the bulb 14. The leaf spring 32 electrically connects this surface of the bulb 14 with the other wire (i.e. white). The connection of the bulb 14 with the two electrical wires provides the bulb 14 with the electrical power necessary to light the bulb 14.

I claim:

1. A socket for holding a light bulb said socket comprising:

a socket housing including an upstanding circumferential wall, said socket having an open upper end and a substantially closed lower end, wherein an interior of said circumferential wall has three grooves located thereon, wherein each groove has a spring member disposed therein, wherein an exterior surface has three slots thereon, wherein each slot is positioned opposite a groove, wherein said each spring member has an upper end with a hook, wherein each said hook wraps over the upper end of the circumferential wall and extends downwardly into its respective slot, wherein each spring member has a bent lower end which is secured to the substantially closed lower end, wherein each spring member has at least two ridges disposed thereon, said ridges being intermediate the hook and the bent lower end, wherein two of the spring members are circumferentially positioned closer to each other than to the third spring member, and wherein a light bulb is installed into the socket by a user without the user twisting, rotating or threading the bulb into the socket.

2. The socket of claim 1, wherein a user installs the light bulb into the socket by pushing the bulb into the socket.

3. The socket of claim 2, wherein the user removes the light bulb from the socket by pulling the bulb from the socket.

4. The socket of claim 3, wherein the spring members elongate as bulb is pushed into the socket.

5. The socket of claim 4, wherein the spring members elongate as the ridges flatten.

6. The socket of claim 5, wherein each of the spring members is secured through the substantially closed by an electrically conductive rivet.

7. The socket of claim 6, wherein a leaf spring member is secured through the substantially closed lower end by an electrically conductive rivet.

8. The socket of claim 7, wherein an outer surface of the substantially closed lower end is provided with two conductive areas, wherein each conductive surface has a wire contact for securing the lead of an electrical wire thereon.

9. The socket of claim 8, wherein the socket is made from a heat resistant plastic.

10. The socket of claim 9, wherein each of the spring members is made of a metal selected from the group consisting of copper, brass, or aluminum.

11. A socket for holding a light bulb said socket comprising:

a socket housing including an upstanding circumferential wall, said socket having an open upper end and a substantially closed lower end, wherein an interior of said circumferential wall has three grooves located thereon, wherein each groove has a spring member disposed therein, wherein an exterior surface has three slots thereon, wherein each slot is positioned opposite a groove, wherein said each spring member has an upper end with a hook, wherein each said hook wraps over the upper end of the circumferential wall and extends downwardly into its respective slot, wherein each spring member has a bent lower end which is secured to the substantially closed lower end, wherein each spring member has at least two ridges disposed thereon, said ridges being intermediate the hook and the bent lower end, wherein each of the spring members has a first surface that faces radially outward toward the inner surface of the circumferential wall, wherein the first surface of each spring member is spaced from the inner surface of said circumferential wall, and wherein a light bulb is installed into the socket by a user without the user twisting, rotating or threading the bulb into the socket.

12. The socket of claim 11, wherein a user installs the light bulb into the socket by pushing the bulb into the socket.

13. The socket of claim 12, wherein the user removes the light bulb from the socket by pulling the bulb from the socket.

14. The socket of claim 13, wherein the spring members move towards the inner surface of the circumferential wall as the bulb is pushed into or pulled from the socket.

15. The socket of claim 14, wherein each of the spring members is secured through the substantially closed lower end by an electrically conductive rivet.

16. The socket of claim 15, wherein a leaf spring member is secured through the substantially closed lower end by an electrically conductive rivet.

17. The socket of claim 16, wherein an outer surface of the substantially closed lower end is provided with two conductive areas, wherein each conductive surface has a wire contact for securing the lead of an electrical wire thereon.

18. The socket of claim 17, wherein the socket is made from a heat resistant plastic.

19. The socket of claim 18, wherein each of the spring members is made of a metal selected from the group consisting of copper, brass, or aluminum.

20. The socket of claim 19, wherein the spring members are equally spaced from each other about the circumference of the circumferential wall.

21. The socket of claim 19, wherein the spring members are not equally spaced from each other about the circumference of the circumferential wall.

* * * * *